US007781981B2

(12) United States Patent
Winkel et al.

(10) Patent No.: US 7,781,981 B2
(45) Date of Patent: Aug. 24, 2010

(54) CIRCUIT ARRANGEMENT FOR A STARTING UNIT OF A DISCHARGE LAMP

(75) Inventors: Michael Winkel, Karl-Borbeck (DE); Karl Schmidt, Kirchstrasse (DE)

(73) Assignee: HEP Tech Co. Ltd., Taichung (TW)

( * ) Notice: Subject to any disclaimer, the term of this patent is extended or adjusted under 35 U.S.C. 154(b) by 605 days.

(21) Appl. No.: 11/793,249

(22) PCT Filed: Dec. 16, 2005

(86) PCT No.: PCT/EP2005/013566

§ 371 (c)(1),
(2), (4) Date: Aug. 24, 2007

(87) PCT Pub. No.: WO2006/063845

PCT Pub. Date: Jun. 22, 2006

(65) Prior Publication Data

US 2008/0001548 A1 Jan. 3, 2008

(30) Foreign Application Priority Data

Dec. 16, 2004 (DE) ..... 10 2004 060 471
Jan. 13, 2005 (DE) ..... 20 2005 000 542 U

(51) Int. Cl.
*H05B 37/00* (2006.01)

(52) U.S. Cl. ..... 315/289; 315/209 M; 315/307; 315/276; 315/DIG. 5

(58) Field of Classification Search ..... 315/171, 315/172, 177, 239, 240, 225, 244, 209 CD, 315/209 M, 276, 289, 290, DIG. 5
See application file for complete search history.

(56) References Cited

U.S. PATENT DOCUMENTS 4,890,041 A * 12/1989 Nuckolls et al. ..... 315/225
5,004,960 A * 4/1991 Cockram et al. ..... 315/307
5,151,631 A * 9/1992 Oda et al. ..... 315/127
6,114,797 A * 9/2000 Bishop et al. ..... 310/318

FOREIGN PATENT DOCUMENTS

DE 319155 2/1920
DE 850012 9/1952
DE 8616255 1/1988

* cited by examiner

*Primary Examiner*—Haissa Philogene
(74) *Attorney, Agent, or Firm*—Allston L. Jones; Peters V erny, LLP

(57) ABSTRACT

The invention relates to a switching arrangement for an ignition device of a discharge lamp (1), comprised of a spark gap formed by three or more electrodes (11) and connected in series with the primary winding (8) of a superimposed transformer (3) and a surge capacitor (9). The invention proposes a cylindrically shaped configuration for the electrodes (11), with the cylinder axes (12) being arranged side by side and in parallel to each other, i.e. in such a manner that a multiple-stage spark gap in air is formed vertically to the cylinder axes (12). Furthermore, the invention relates to an ignition device for a high-pressure discharge lamp.

16 Claims, 4 Drawing Sheets

CIRCUIT ARRANGEMENT FOR A STARTING UNIT OF A DISCHARGE LAMP

CROSS REFERENCE TO RELATED APPLICATIONS

This application claims priority on International Application PCT/EP2005/013566 filed 16 Dec. 2005 and claims priority on:

German 10 2004 060 471.1 filed 16 Dec. 2004

German 20 2005 000 542.8 filed 13 Jan. 2005

All applications cited herein are incorporated herein by reference.

FIELD OF THE INVENTION

The present invention relates to a switching arrangement for an ignition device of a discharge lamp, comprised of a spark gap which is formed by three or more electrodes and connected in series with the primary winding of a superimposed transformer and a surge capacitor.

Furthermore the invention relates to an ignition device for a high-pressure discharge lamp with an ignition pulse generator which is comprised of an ignition circuit formed by a surge capacitor, the primary winding of a superimposed transformer and a switching element, and of a high-voltage generator to charge the surge capacitor.

BACKGROUND OF THE INVENTION

The operation of discharge lamps requires ballasts, for example in form of iron-cored reactors, as is widely known. Additionally required are ignition devices which generate high-voltage pulses to switch the lamps on and by means of which the ionization of the gas mixture existing in the lamps is initiated.

Ignition devices of discharge lamps usually work in accordance with the so-called superposition principle similar to a tesla transformer. Known ignition devices are comprised of an ignition pulse generator to generate the required voltage pulses. The ignition pulse generator is comprised of an ignition circuit which consists of a surge capacitor, the primary winding of a superimposed transformer and a switching element. The surge capacitor must be charged with high voltage to achieve the required voltage of ignition pulses. With prior art ignition devices, this purpose is served by a high-voltage generator of the ignition pulse generator. The high-voltage generator usually works by the aid of a transformer to generate the high voltage needed for charging from the available line voltage. During the ignition procedure, the charged surge capacitor is periodically discharged through the primary winding of the superimposed transformer by switching the switching element periodically on and off. In the switched-on status, the surge capacitor and the primary winding of the superimposed transformer develop a high-frequency resonant circuit. The high-frequency oscillations are transformed-up in the secondary winding of the superimposed transformer connected with the lamp and are available to the lamp as ignition voltage.

Frequently used as switching elements with prior art ignition devices are spark gaps. The spark gap ignites when the surge capacitor has been charged to a certain starting (turn-on) voltage. The spark gap continues to be conductive until the surge capacitor has been discharged via the primary winding of the superimposed transformer to a certain turn-off voltage.

Owing to the high electric currents which flow in the ignition circuit when discharging the surge capacitor, the gas ionized in the spark gap is heated-up to such an extent that de-ionization is impeded. For this reason, it takes an undesirably long time before the spark gap turns-off. The relatively long de-ionization time takes the effect that ignition pulses can only be generated with comparably low frequencies. But it is especially with ignition devices which are to be suitable for hot ignition of high-pressure discharge lamps that it is required to generate ignition pulses with a high voltage (20 to 60 kV) with a particularly high frequency, because as a rule more than 1000 ignition pulses per second are necessary during an ignition time of several seconds in order to ensure a reliable re-ignition of high-pressure discharge lamps operating at rated load.

Known from DE 86 16 255 U1 is a switching arrangement for an ignition device of a discharge lamp. With this switching arrangement, a multiple-stage spark gap is implemented which is composed of two or more individual spark gaps. As compared with single-stage spark gaps, a division into several spark gaps has the advantage that the de-ionization time is noticeably reduced. Among other reasons, this is attributable to the improved cooling obtained with a multiple-stage arrangement. The prior art switching arrangement is particularly suitable for use in an ignition circuit of a high-pressure discharge lamp. The multiple-stage spark gap allows for generating up to 4000 ignition pulses per second.

However, the switching arrangement known from prior art in technology has the drawback that the spark gap is of a comparably costly and expensive design and construction. With the prior art arrangement, the electrodes of the spark gap constitute massive copper bodies which are concentrically arranged, one behind the other in axial direction, in an insulating material tube. The gas discharge slots between the individual electrodes are filled with a special gas mixture which is partly comprised of hydrogen. The front faces of the electrodes are provided with an activation layer made of sodium silicate and another metal component. On account of the special materials of the electrodes and because of the gas filling of the entire arrangement, the prior art spark gap is extremely costly in production. The ignition devices for discharge lamps equipped therewith are accordingly expensive.

SUMMARY OF THE INVENTION

Against this background, it is the object of the present invention to provide a switching arrangement for an ignition device of a discharge lamp which is of a simple set-up and which can be produced at low cost. Accordingly, the switching arrangement is to be suitable for ignition devices which allow for a hot ignition of high-pressure discharge lamps.

This object is achieved by the invention, proceeding from a switching arrangement of the afore-mentioned kind in a way that the electrodes are of a cylindrical shape, with the cylinder axes being arranged side by side and in parallel to each other, in such a manner that a multiple-stage spark gap in air is formed vertically to the cylinder axes.

An essential aspect of the present invention is the use of electrodes for the spark gap which can be produced as easily as possible. The electrodes used according to the present invention have a cylindrical shape and can be manufactured as simple rotating parts. Suitable as material for the electrodes is V4A steel, which is a standard material available at low cost. In accordance with the present invention, line-shaped gas discharge slots are formed between the cylindrically shaped electrodes arranged side by side, and this shaping of the gas discharge slots in combination with the multiple-stage configuration of the spark gap leads to a particularly good cooling so that the de-ionization time of the spark gap is particularly short. Thus, it is possible to achieve short switching times and/or high pulse frequencies for ignition of the discharge lamp. This is promoted by the fact that the spark gap according to the present invention is a spark gap in air which, therefore, is freely accessible towards the outside. Hence, a heat discharge by circulation of air and/or by convection is possible. Moreover, the spark gap in air has the advantage that no special gas mixtures and, accordingly, no gastight sheathing are required, Accordingly, the production of the inventive switching arrangement is simple and can be done at low cost.

The electrodes of the inventive switching arrangement may expediently be comprised of a bore arranged concentrically to the cylinder axis and provided to accommodate a fastening bolt. Thereby, it is particularly easy to arrange the electrodes side by side and to align them in parallel to each other as provided for in accordance with the present invention.

It is particularly practical if the electrodes are fastened with their bottom side to a carrier plate comprised of an electrically isolating material. The afore-mentioned fastening bolts can be used for this purpose. A particularly stable and robust arrangement is obtained if a cover plate made of the electrically isolating material is provided for at which the electrodes are fastened with their top side. Suitable as material for the carrier plate and/or cover plate are the well-known and low-cost plastic materials (e.g. a fiber-reinforced printed circuit board material FR4), which printed boards are usually made of.

Hence, the cylinder axes of electrodes are arranged vertically to the carrier plate and/or cover plate. By fastening the electrodes to the top side and bottom side it is ensured that parallelism between the cylinder axes of electrodes and, thus, a constant width of discharge slots connected one behind the other are adhered to, even though mechanical forces impact on the arrangement from outside. Such forces would cause the overall arrangement comprised of three or more electrodes to be shifted in the way of a parallelogram. Parallelism between the cylinder axes is maintained and the width of the discharge slots on the whole varies just slightly. For these reasons, the inventive switching arrangement is particularly reliable, even if subjected to strong mechanical stresses like those which frequently occur on hot ignition procedures of high-pressure discharge lamps.

Furthermore, the carrier plate and/or cover plate with the inventive switching arrangement may have slots running transversely to the spark gap. By way of these slots it is avoided that conductive paths (leakage paths) develop on the carrier plate or cover plate. This would inevitably lead to a failure of the ignition devices working with the inventive switching arrangement. Furthermore, these slots improve the cooling of the spark gap in air.

In accordance with a sensible advanced development of the inventive switching arrangement, the surge capacitor is connected with the carrier plate, there being a printed conductor provided on the carrier plate to connect an electrode of the surge capacitor with an electrode of the spark gap. Thereby, it results a particularly simple mechanical set-up which needs no additional wiring between the surge capacitor and the electrodes of the spark gap. In this manner, the surge capacitor together with the spark gap of the inventive switching arrangement forms a construction unit which is practical during assembly and maintenance of the ignition device.

It makes sense if the electrodes of the spark gap with the inventive switching arrangement have rounded-off edges in the transitional area between the cylinder shell and the front faces of the electrodes. Excessive electrical field intensities in the area of edges are hereby avoided which would lead to a hardly controllable ignition behavior of the spark gap.

High-pressure discharge lamps with a high performance rate are generally devised for operation at a three-phase current net, in most cases for 400 V at 50 Hz. At the input terminals of such high-pressure discharge lamps, there are two different phases of a three-phase current supply net. The operation of high-pressure discharge lamps usually requires ballasts, e.g. in form of iron-cored reactors. In addition, ignition devices are required which generate high-voltage pulses to turn-on the lamps and by means of which the ionization of the gas mixture existing in the lamps is initiated.

High-duty discharge lamps, e.g. metal halogenide and sodium high-pressure lamps, are virtually utilized for industrial purposes only. On account of their high efficiency degree and their high cost effectiveness, they have advantages in this field as compared with incandescent and fluorescent lamps. High-duty high-pressure discharge lamps are frequently utilized for illumination of large free rooms, e.g. construction sites, sport stadiums, parking lots, warehouses or the like, and even for road illumination.

In terms of switching-on of high-pressure discharge lamps, a differentiation must be made between an ignition in cold status and the so-called hot ignition in rated-load status of the lamps.

On ignition in cold status high-voltage pulses with an amplitude of less than 5 kV are sufficient to safely start the lamps. However, if a high-pressure discharge lamp is to be ignited again in rated-load status, it is to be considered that a high vapor pressure of the gas filling of the lamp prevails in the lamp which takes the effect that it is more difficult to initiate the ionization of the gas filling.

On hot ignition of high-pressure discharge lamps, voltage pulses with amplitudes of 20 to 60 kV are therefore required with which the lamps have to be charged again and again. As a rule, it takes more than 1000 ignition pulses per second during an ignition time in order to ensure a reliable re-ignition of a high-pressure discharge lamp operating at rated load. In practice, ignition devices for hot ignition of high-pressure discharge lamps are often connected to a separate power supply.

Mains-operated ignition devices constitute state of the art technology. They work according to the initially described superposition principle. Such an ignition device is known, for example, from DE 27 44 049 C2. With this prior art ignition device, both the ignition pulse generator and the high-pressure discharge lamp receive their supply from the same single-phase alternate current system.

In practice, those ignition devices of high-pressure discharge lamps which have a high rating and which receive their power supply from a three-phase current system are often connected to a separate (e.g. a single-phase) electric power supply system. On designing the ignition devices for such high-pressure discharge lamps, the requirements specified by lamp producers must be taken into account. These requirements do not only relate to the amplitudes of ignition pulses as well as to their number and frequency, but also to the phase angle of ignition pulses relative to the a.c. voltage existing at the input terminals of a high-pressure discharge lamp. With high-pressure discharge lamps of the type HQI 2000 W/D/S, for example, the producer demands that the ignition pulses have an amplitude of at least 36 kV, with it being required to issue at least 10 ignition pulses per mains half-wave from the ignition device for hot ignition of the lamp. The ignition device must be properly designed in conformity with the requirements specified by the lamp producer so that it will generate the ignition pulses during the phase-angle intervals 60° el to 90° el and 240° el to 300° el.

Such producer requirements cannot be fulfilled by the ignition device known from the afore-mentioned DE 27 44 049 C2.

Against this background, it is another object of the present invention to provide an ignition device for a high-pressure discharge lamp with which it is ensured that the ignition pulses generated by the ignition device have the phase angle relative to the a.c. voltage existing at the lamp as demanded by the lamp producer. Moreover, the ignition device is required to be operable at a mains connection which is different from the mains connection of the high-pressure discharge lamp.

This object is achieved by the present invention proceeding from an ignition device of the initially mentioned kind in such a manner that a control unit for turning the high-voltage generator on and off is provided for, with the control unit being connected to a synchronization circuit for synchronizing the operation of the high-voltage generator with the a.c. voltage existing at the input terminals of the high-pressure discharge lamp.

In accordance with the present invention, the ignition device has an electronic control unit, by way of which the high-voltage generator is activated only during the desired ignition phase-angle intervals of the a.c. voltage existing at the lamp as specified by the lamp producer. As the ignition device is to be operable at a mains connection which is different from the mains connection of the high-pressure discharge lamp, a synchronization circuit is provided for in conformity with the present invention. It serves for enabling the control unit to control the turn-on and turn-off procedures of the high-voltage generator in terms of time in such a manner that the ignition pulses have the correct phase angle. It is of special advantage that the synchronization circuit of the inventive ignition device ensures compliance with the specified ignition phase-angle intervals, no matter which relative phase angle the mains connection of the high-pressure discharge lamp and the possibly separate mains connection of the ignition device do have.

Another advantage of the inventive ignition device lies in that it is equally usable for high-pressure discharge lamps which are operated between two phases of a three-phase current mains system (e.g. 400 V, 50 Hz) or which are connected to a single-phase a.c. mains system (e.g. 230 V, 50 Hz). Regardless of the lamp rating, the ignition device is universally usable, particularly for hot ignition.

With the inventive ignition device, the surge capacitor, primary winding of the superimposed transformer and the switching element expediently form a series resonant circuit. As described before, the resonant circuit oscillates in a high-frequency range as soon as it is closed by means of the switching element. By means of these oscillations, the ignition pulses supplied to the high-pressure discharge lamp are induced in the secondary winding of the superimposed transformer. On account of the required level of the ignition voltage, frequencies in a range from 1 MHz up to approx. 10 MHz are eligible for the oscillations of the ignition circuit.

In accordance with an advantageous embodiment, the switching element which closes the ignition circuit of the inventive ignition device is a spark gap. The spark gap switches through automatically as soon as the surge capacitor has been charged to a certain voltage level. Especially suitable as switching element for the ignition device is an arrangement with a spark gap of the aforementioned kind.

The high-voltage generator of the inventive ignition device can be operated on a single-phase a.c. mains system. As outlined before, the high-voltage generator can be connected to a phase of an a.c. supply system that is different from the phases of a power supply system which a high-pressure discharge lamp is connected to. For example, the high-pressure discharge lamp can be operated between two phases of a three-phase power supply system, whereas the high-voltage generator is operated at another phase of the three-phase power supply system versus a neutral conductor. Accordingly, it is of special advantage that the phases of the three-phase power supply system for the high-pressure discharge lamp and for the high-voltage generator can be chosen at will without any necessity for complying with a certain wiring scheme. This is possible because the correct phase angle of the ignition pulses is ensured by the synchronization circuit of the inventive ignition device. Hence, the inventive ignition device can be used particularly universally if it is operated on a single-phase a.c. power supply system, because a neutral conductor is practically always available, even with a three-phase current connection from which the lamp possibly receives its power supply. Therefore, the ignition device can always be used without any problems, regardless of the available mains connection.

In accordance with an advantageous configuration of the inventive ignition device, the synchronization circuit may have a zero crossing detection circuit. Zero crossings of the a.c. voltage existing at the input terminals of the high-pressure discharge lamp are thereby detected. As the synchronization circuit configured in this manner determines the phase angle of the a.c. voltage existing at the high-pressure discharge lamp based upon these zero crossings, the control unit can turn the high-voltage generator on and off at the correct moments based upon the signal from the zero crossing detection circuit so that the ignition pulses are generated with the correct phase angle.

Furthermore it is expedient that the synchronization circuit of the inventive Ignition device has an auxiliary circuit to generate an auxiliary synchronization signal which is phase-synchronous to the supply voltage of the high-voltage generator. Accordingly, the auxiliary synchronization signal may be any signal, preferably a digital signal which is phase-synchronous to the supply voltage of the high-voltage generator. From the (digital) signal of the zero crossing detection circuit and from the auxiliary synchronization signal, a control signal supplied to the high-voltage generator can then be generated by means of the control unit in a simple manner. By way of the control signal, the high-voltage generator is only turned-on during specified ignition phase-angle intervals of the a.c. voltage existing at the high-pressure discharge lamp. For this purpose, the electronic system of the control unit determines the phase difference between the signal from the zero crossing detection circuit and the auxiliary synchronization signal. Hereof, it is then possible to calculate the turn-on and turn-off moments depending on the specified ignition phase-angle intervals for the control signal. The time-relevant control of turning the high-voltage generator on and off is then made on the basis of the auxiliary synchronization signal, with it being possible, for example, to take recourse to a certain ascending or descending flank of the auxiliary synchronization signal, utilizing it as time basis. Proceeding from this time basis, turning-on and off is executed with a time delay which results from the previously determined phase difference between the signal from the zero crossing detection circuit and the auxiliary synchronization signal as well as the specified ignition phase-angle intervals.

In accordance with another advantageous configuration, the inventive ignition device is comprised of a lamp current detection circuit connected with the control unit to detect an operating current flowing through the high-pressure discharge lamp. The signal from the lamp current detection circuit is utilized by the control unit to turn-off the high-voltage generator permanently, if it is ascertained based upon the flowing operating current that the high-pressure discharge lamp has ignited.

BRIEF DESCRIPTION OF THE DRAWINGS

Examples of the embodiments of the present invention are explained in the following by way of various figures, where.

DETAILED DESCRIPTION OF THE PREFERRED EMBODIMENT

Figure 1:
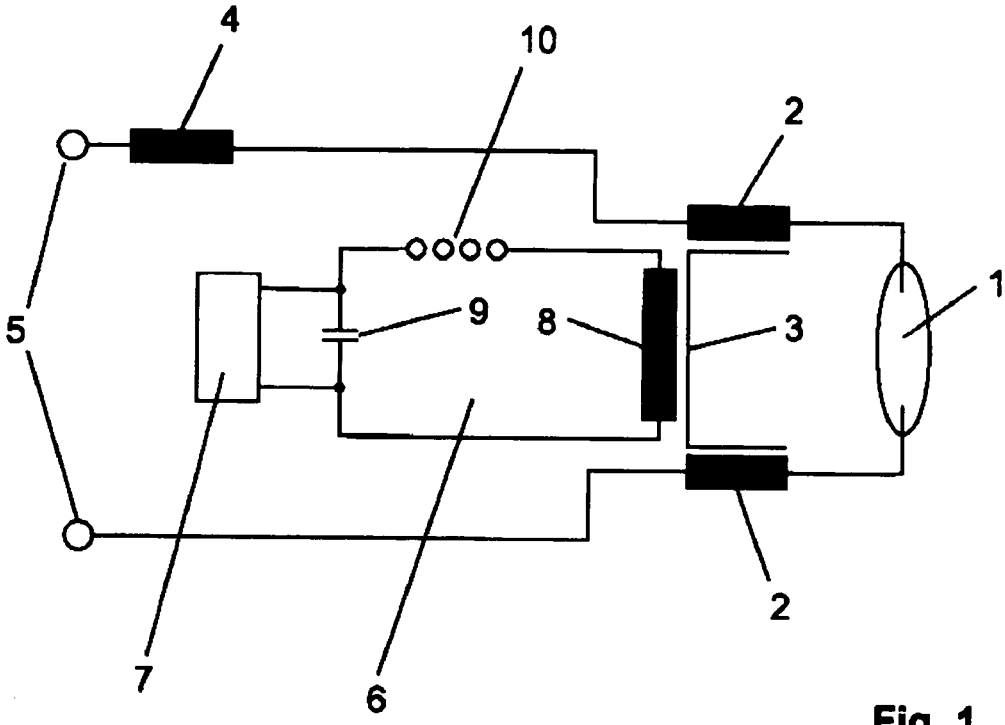
FIG. 1 shows a sketched circuit diagram of an ignition device with the inventive switching arrangement.

With the switching circuit shown in FIG. 1, a discharge lamp 1 is connected to secondary windings 2 of a superimposed transformer 3. Via secondary windings 2 and an intermediately connected iron-cored reactor 4, the discharge lamp 1 is connected with main connection terminals 5. An ignition device comprised of an ignition circuit 6 and a high-voltage generator 7 serves for ignition of the discharge lamp 1. The ignition circuit 6 is comprised of the primary winding 8 of the superimposed transformer 3, a surge capacitor 9 as well as a spark gap 10 as an auto-operating switching element. The surge capacitor 9 is charged by means of the high-voltage generator 7. The surge capacitor 9 and the primary winding 8 of the superimposed transformer 3 form a series resonant circuit oscillating within the MHz range. If surge capacitor 9 has been charged to a certain high-voltage level, the spark gap 10 ignites. At this moment, the ignition circuit 6 is closed, and a high-frequency oscillation develops in the primary winding 8 of the superimposed transformer 3. In secondary windings 2, this oscillation is transformed-up so that ignition pulses of opposite polarity exist symmetrically at the connection terminals of discharge lamp 1. Accordingly, the secondary windings 2 of the superimposed transformer 3 have inverse windings.

By means of the high-voltage generator 7, the surge capacitor 9 is charged continuously. At time intervals of less than one millisecond, spark gap 10 disrupts so that the discharge lamp 1 is charged with ignition pulses with an appropriate frequency. According to the present invention, spark gap 10 is configured as a multiple-stage spark gap in air.

Figure 2:
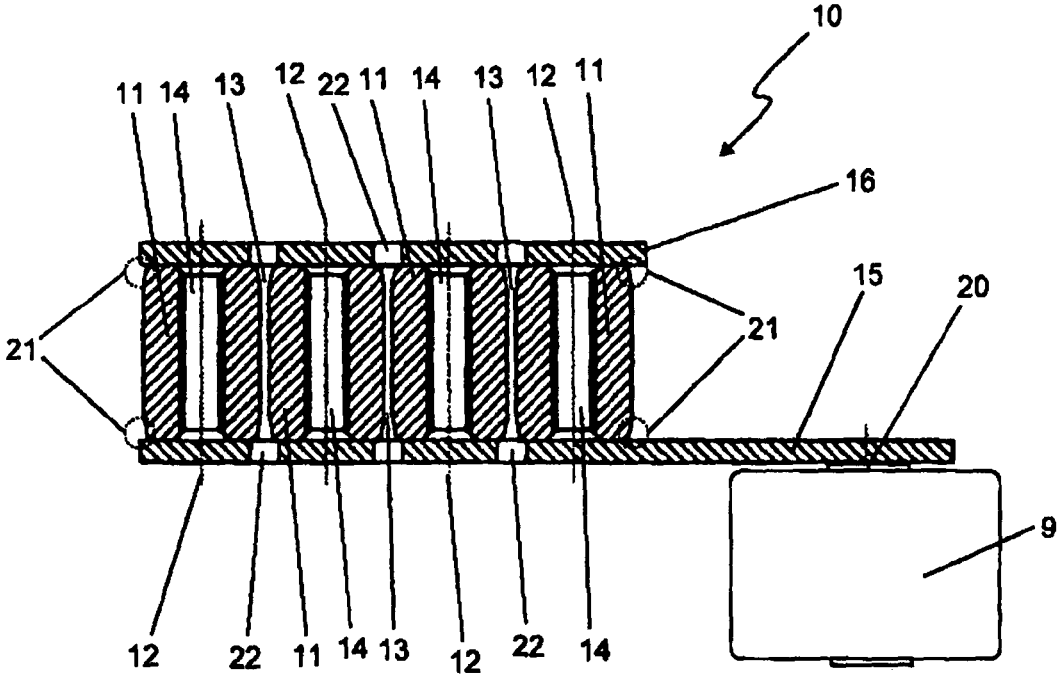
FIG. 2 shows a sectional side view of a spark gap in accordance with the present invention.

As shown with the embodiment exemplified in FIG. 2, the spark gap 10 is comprised of four cylindrically shaped electrodes 11, with the cylinder axes 12 being arranged side by side and in parallel to each other, i.e. in such a manner that a multiple-stage spark gap in air is formed vertically to the cylinder axes 12. By way of the gaps between electrodes 11, three line-shaped discharge slots 13 are formed as shown in the illustrated example of the embodiment. The geometry of the discharge slots 13 decisively determines the ignition behavior of the spark gap, above all the starting voltage, turn-off voltage as well as the de-ionization time. For exact positioning of electrodes 11 relative to each other, they have concentric bores 14 for fastening bolts and/or pins not shown more closely in this figure. With the illustrated example of the embodiment, electrodes 11 are fastened with their bottom side to a carrier plate 15 and with their top side to a cover plate 16. The carrier plate 15 and the cover plate 16 are comprised of an electrically isolating printed-circuit board material.

Figure 3:
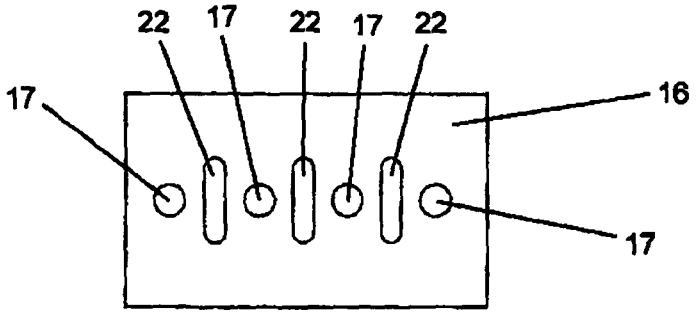
FIG. 3 shows a carrier plate and a cover plate of the spark gap according to FIG. 2 in a top plan view.
Figure 3:
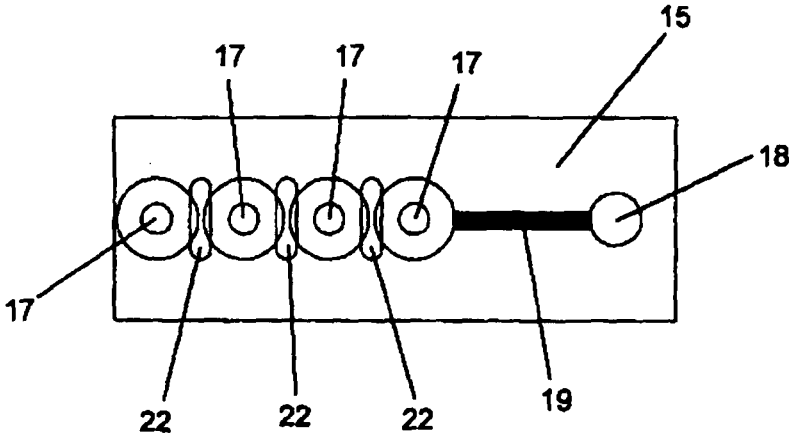

FIG. 3 shows the carrier plate 15 and the cover plate 16 in a top plan view. By means of precisely arranged bores 17, the fastening bolts for electrodes 11 at the carrier plate 15 and/or cover plate 16 are stipulated. Furthermore, a bore 18 for fastening an electrode of surge capacitor 9 is provided for at carrier plate 15. The overall arrangement comprised of the spark gap 10 and surge capacitor 9 is shown in FIG. 2. On the top side of carrier plate 15, a printed conductor 19 is provided for connection of an electrode 10 of surge capacitor 9 with an electrode 11 of spark gap 10.

As shown in FIG. 2, the electrodes have circumferentially rounded-off edges in the transitional area 21 between the cylinder shell and the front faces.

Moreover, FIGS. 2 and 3 show that the carrier plate 15 and cover plate 16 have slots 22 running transversely to the spark gap.

These slots can be mounted by way of a simple milling procedure applied at the carrier plate 15 and cover plate 16. The width and length of slots 22 is properly chosen to amply enhance possible leakage paths at the upper side of carrier plate 15 and/or cover plate 16.

Figure 4:
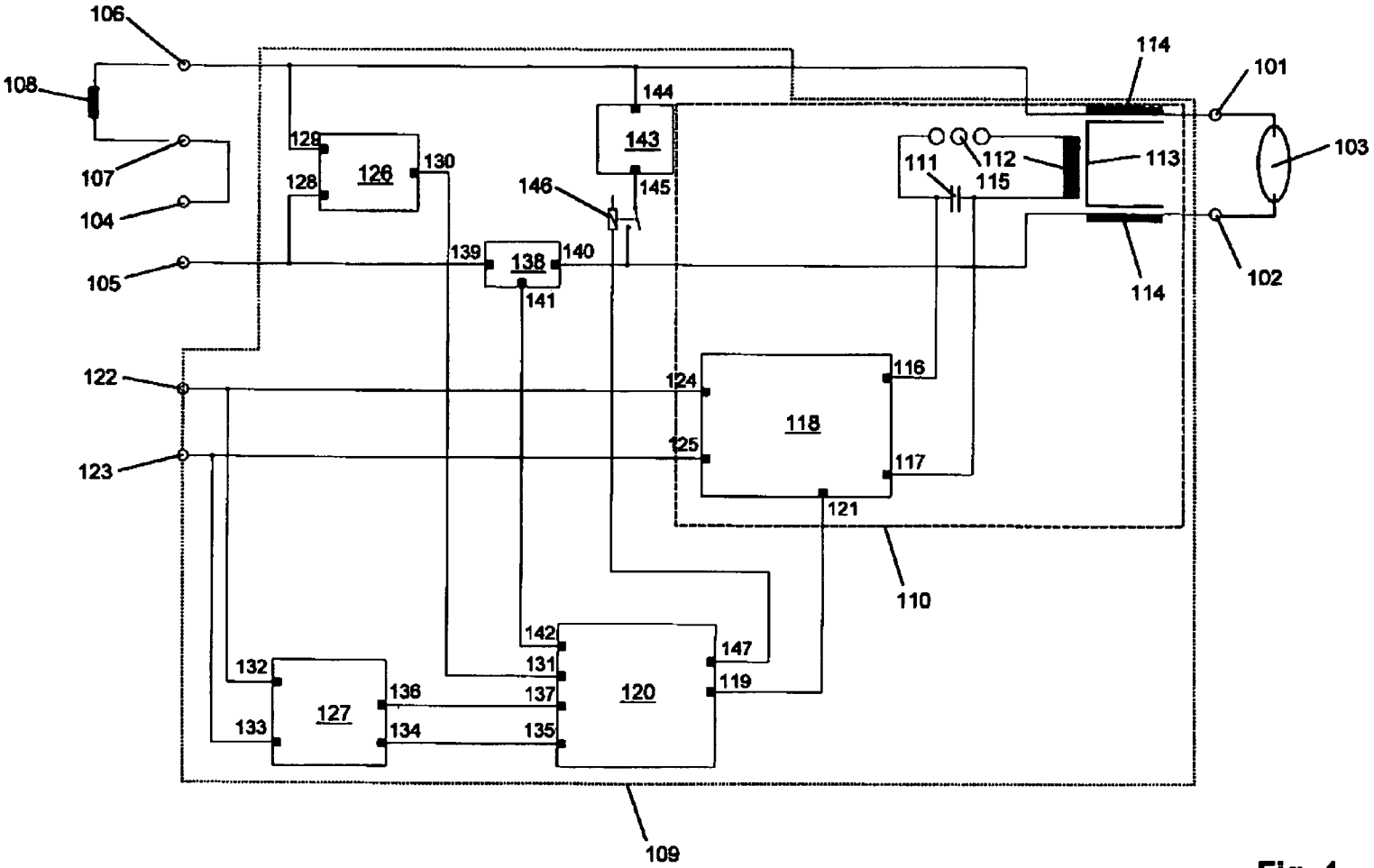
FIG. 4 shows a block diagram of the inventive ignition device.

Connected at terminals 101 and 102 of the switching circuit illustrated in FIG. 4 is a high-pressure discharge lamp 103. It is connected via terminals 104 and 105 with two phases of a three-phase current supply system. The supply voltage existing at terminal 104 is supplied to the high-pressure discharge lamp 103 via a ballast 108 connected at terminals 106 and 107. Ballast 108 may be a conventional iron-cored reactor. Furthermore, FIG. 4 shows an ignition device 109 with an ignition pulse generator 110. The ignition pulse generator 110 is comprised of a surge capacitor 111, a primary winding 112, and a superimposed transformer 113. Secondary windings 114 of the symmetrically built-up superimposed transformer 113 are connected with the connecting terminals 101 and 102 of the high-pressure discharge lamp 103. Furthermore, the ignition pulse generator 110 is comprised of a spark gap 115 according to FIG. 1 to 3 as an auto-operating switching element. Surge capacitor 111, primary winding 112 of the superimposed transformer 113 and the switching element 115 form a series resonant circuit oscillating with the MHz range. Surge capacitor 111 is connected with output terminals 116, 117 of a high-pressure generator 118. High-voltage generator 118 serves for charging the surge capacitor 111. If surge capacitor 111 has been charged to a certain high-voltage level, spark gap 115 switches through. At this moment, the ignition circuit is closed and a high-frequency oscillation is created in the primary winding 112 of the superimposed transformer 113. This oscillation is transformed-up in the secondary windings 114 so that ignition pulses of opposite polarity symmetrically exist at the connecting terminals 101, 102. For this purpose, the secondary windings 114 of the superimposed transformer 113 expediently have inverse windings. Via a connection 119, a control unit 120 is connected with a control connection 121 of the high-voltage generator 118. Corresponding to the control signal from control unit 120 supplied via the control connection 121, the high-voltage generator 118 is turned on and off, respectively. While the high-voltage generator 118 has been turned-on, the surge capacitor 111 is charged continually. With time intervals of less than 1 millisecond, the spark gap 115 disrupts so that the high-pressure discharge lamp 103 is charged with ignition pulses in a corresponding frequency. The high-voltage generator 118 is connected via a terminal 122 to a phase of the three-phase current supply system which differs from those phases that are connected to the terminals 104 and 105, respectively. Via a terminal 123, the high-voltage generator 115 is connected to the neutral conductor of the three-phase current supply system so that on the whole the high-voltage generator is operated via its input connections 124 and 125 at a single-phase a.c. supply net. For synchronizing the operation of the high-voltage generator 118 with the a.c. voltage existing at terminals 101 and 102 of the high-pressure discharge lamp, the switching circuit illustrated in FIG. 1 furthermore comprises a zero crossing detection circuit 126 to detect zero crossings of the a.c. voltage existing at the input connections 101, 102 of the high-pressure discharge lamp 103 as well as an auxiliary circuit 127 to generate an auxiliary synchronization signal which is phase-synchronous to the supply voltage of the high-voltage generator 118. Through input connections 128, 129, the zero crossing detection circuit 126 is connected with terminals 105 and/or 106. If the a.c. voltage existing between these terminals has a zero crossing, a corresponding digital signal is generated at an output connection 130 of the zero crossing detection circuit 126 which is supplied to an input connection 131 of the control unit 120. The terminals 122 and 123 are connected with connecting terminals 132 and/or 133 of the auxiliary circuit 127. Thereby, the auxiliary circuit 127 is connected to the single-phase a.c. power supply system. With the illustrated example of the embodiment, the auxiliary circuit 127 has a dual function. On the one hand, the auxiliary circuit 127 generates a d.c. voltage at an output connection 134 which is supplied via a connection 135 for supply of energy to control unit 120. Existing at one output connection 136 is the auxiliary synchronization signal which is supplied to the control unit 120 via an input connection 137. From the signal existing at connecting terminal 131 of the zero crossing detection circuit 126 and from the auxiliary synchronization signal existing at the connecting terminal 137, the control unit 120 generates the control signal which is supplied to the high-voltage generator 118 via connecting terminals 119 and/or 121. Initially, the control unit 120 determines the phase difference between the zero crossing detection circuit 126 and the auxiliary synchronization signal, and hereof it determines the moments for turning the high-voltage generator 118 on and off, respectively, depending on the specified ignition phase-angle intervals. After the phase difference between the signal from the zero crossing detection circuit 126 and the auxiliary synchronization signal has been determined, the control of the high-voltage generator 118 is executed on the basis of the auxiliary synchronization signal. Compliance with the correct phase angle of the ignition pulses is assured by the determination of the phase difference, i.e. regardless of the relative phase relation which the mains voltages existing at terminals 104, 105 and 122 do have. Furthermore, the ignition device 109 illustrated in FIG. 1 has a lamp current detection circuit 138. It is integrated via connecting terminals 139 and 140 into the power supply line of the high-pressure discharge lamp 103. As soon as an electric current flows between the connections 139 and 140 which indicates that the high-pressure discharge lamp 103 has ignited, a digital signal is generated at a connection 141 which is supplied via a connection 142 to the control unit 120. If this signal is received, the control unit 120 deactivates the high-voltage generator 118 permanently to ensure that the high-pressure discharge lamp 103 is no longer charged unnecessarily with ignition pulses after the ignition. Besides, an auxiliary ignition circuit 143 is provided for which is mainly comprised of an auxiliary ignition capacitor and a series resistance to the auxiliary ignition capacitor, and which is dimensioned and rated in accordance with the requirements specified by the lamp producer. The series circuit comprised of the auxiliary ignition capacitor and the resistance is connected with connecting terminals 144, 145, and by means of a relay 146 it can be switched in parallel to the high-pressure discharge lamp 103. During the ignition procedure, the series circuit comprised of the auxiliary ignition capacitor and the resistance serves for temporarily maintaining the half-wave voltage existing at lamp terminals 101 and 102, and thus it serves as an ignition aid. Relay 146 is actuated by the control unit 120 and for this purpose it is connected via a connecting terminal 147 to the control unit 120.

Figure 5:
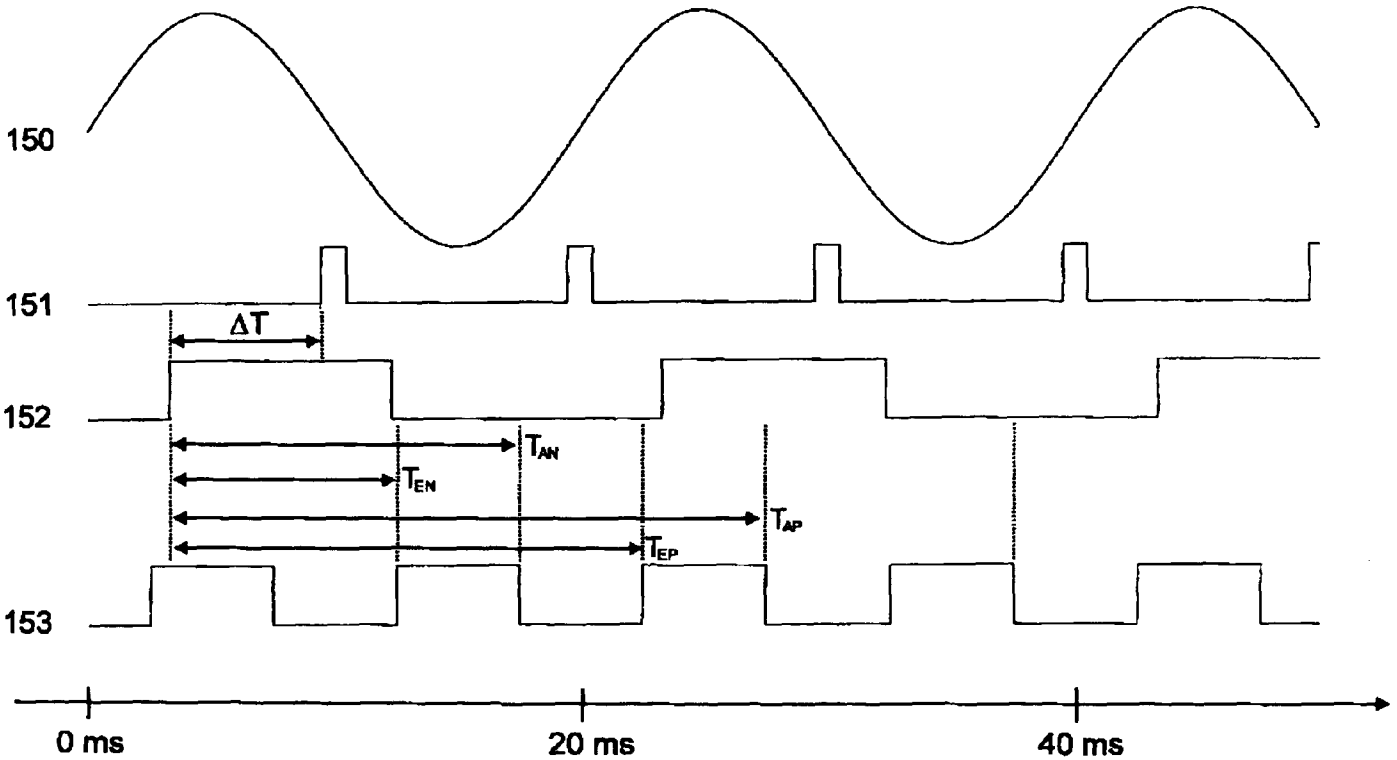
FIG. 5 illustrates the time-relevant control of the inventive ignition device.

FIG. 5 shows the time-related signal courses addressed hereinabove which are essential for the function of the inventive ignition device. Designated with reference number 150 is the 50 Hz a.c. voltage existing at the high-pressure discharge lamp 103. Signal 151 has been received at the output connection 130 of the zero crossing detection circuit 126. The zero crossing detection circuit 126 generates a short digital pulse each time when the alternating voltage 150 has a zero crossing. The auxiliary crossing 127 generates the auxiliary synchronization signal which is designated with reference number 152 in FIG. 5. Signal 152 is phase-synchronous to the supply voltage of the high-voltage generator 118. From the signals 151 and 152, control unit 120 generates the control signal which is designated with no. 153 in FIG. 5. For this purpose, the control unit 120 initially calculates the phase difference $\Delta T$ between signal 151 and signal 152. Depending on the desired ignition phase-angle intervals (60° el to 120° el and 240° el to 300° el), the moments of turning-on $T_{EP}$, $T_{EN}$ and the moments of turning-off $T_{AP}$, $T_{AN}$—each for the ignition pulses during the positive ($T_{EP}$, $T_{AP}$) and/or negative ($T_{EN}$, $T_{AN}$) half-wave of the supply voltage 150—are calculated from an ascending flank of signal 152 onward. Ignition pulses are generated when the digital signal 153 of control unit 120 has been activated. This is the case one time each during a positive and/or negative half-wave of the supply voltage 150. During each ignition phase-angle interval, ten or more ignition pulses are generated corresponding to the lamp producer's requirements.

The invention claimed is:

1. A switching arrangement for an ignition device of a discharge lamp (1) comprised of a spark gap formed by three or more electrodes (11) and connected in series with the primary winding (8) of a superimposed transformer (3) and a surge capacitor (9), characterized in that the electrodes (11) are of a cylindrically shaped configuration, with cylinder axes (12) being arranged side by side and in parallel to each other, i.e. in such a manner that a multiple-stage spark gap in air is formed vertically to the cylinder axes (12).

2. A switching arrangement as defined in claim 1, characterized in that the electrodes (11) have one bore (14) each being concentric to the cylinder axis (12) to accommodate a fastening bolt.

3. A switching arrangement as defined in claim 1, characterized by a carrier plate (15) made of an electrically isolating material, which the electrodes (11) are fastened to with their bottom side.

4. A switching arrangement as defined in claim 3, characterized by a cover plate (16) made of said electrically isolating material, which the electrodes (11) are fastened to with their top side.

5. A switching arrangement as defined in claim 4, characterized in that the carrier plate (15) and/or the cover plate (16) have slots (22) running transversely to the spark gap.

6. A switching arrangement as defined in claim 3, characterized in that the surge capacitor (9) is connected with the carrier plate (15), there being a printed conductor (19) arranged on the carrier plate (15) to connect an electrode (20) of the surge capacitor (9) with an electrode (11) of the spark gap.

7. A switching arrangement as defined in claim 3, characterized in that the electrodes (11) in the transitional area between the cylinder shell and the front faces of the electrodes have rounded-off edges.

8. An ignition device for a high-pressure discharge lamp (103), with an ignition pulse generator (110) comprised of an ignition circuit formed by a surge capacitor (111), the primary winding (112) of a superimposed transformer (113) and a switching element (115) as well as comprised of a high-voltage generator (118) to charge said surge capacitor (111), characterized by a control unit (120) to turn said high-voltage generator (118) on and off, with said control unit (120) being connected to a synchronization circuit for synchronizing the operation of the high-voltage generator (118) with an alternating current voltage (150) existing at the input connections (101, 102) of the high-pressure discharge lamp (103).

9. An ignition device as defined in claim 8, characterized in that the surge capacitor (111), the primary winding (112) of the superimposed transformer (113) and the switching element (115) form a series resonant circuit.

10. An ignition device as defined in claim 8, characterized in that the switching element (115) is comprised of an arrangement with a spark gap formed by three or more electrodes (11) and connected in series with the primary winding (8) of a superimposed transformer (3) and a surge capacitor (9), characterized in that the electrodes (11) are of a cylindrically shaped configuration, with the cylinder axes (12) being arranged side by side and in parallel to each other, i.e. in such a manner that a multiple-stage spark gap in air is formed vertically to the cylinder axes (12).

11. An ignition device as defined in claim 8, characterized in that the high-voltage generator (118) is connected to a phase of an a.c. power supply system which differs from the phases of a three-phase power supply system to which the high-pressure discharge lamp (103) is connected.

12. An ignition device as defined in claim 8, characterized in that the synchronization circuit is comprised of a zero crossing detection circuit (126) to detect zero crossings of the alternating voltage (150) existing at the input connections (101, 102) of the high-pressure discharge lamp (103).

13. An ignition device as defined in claim 12, characterized in that the synchronization circuit is comprised of an auxiliary circuit (127) to generate an auxiliary synchronization signal (152) which is phase-synchronous to the supply voltage of the high-voltage generator (118).

14. An ignition device as defined in claim 13, characterized in that the control unit (120) is of such a configuration that it generates a control signal (153) from the signal (151) of the zero crossing detection circuit (126) and the auxiliary synchronization signal (152), said control signal being fed to the high-voltage generator (118) in such a manner that the high-voltage generator (118) is turned-on only during specifiable ignition phase-angle intervals of the alternating voltage (150) existing at the high-pressure discharge lamp (103).

15. An ignition device as defined in claim 14, characterized in that the control unit (120) is of such a configuration that it determines the phase difference (AT) between the signal (151) of the zero crossing detection circuit (126) and the auxiliary synchronization signal (152) and that it determines hereof the moments of turning-on and turning-off ($T_E$, $T_A$) depending on the specified ignition phase-angle intervals for the control signal (153).

16. An ignition device as defined in claim 8, characterized by a lamp current detection circuit (138) connected with the control unit (120) for detection of an operating current flowing through the high-pressure discharge lamp (103).

* * * * *